US009119756B2

(12) United States Patent
MacPherson

(10) Patent No.: US 9,119,756 B2
(45) Date of Patent: Sep. 1, 2015

(54) ADJUSTABLE WHEELCHAIR ELEVATING LEG REST

(75) Inventor: Matthew E. MacPherson, Portland, OR (US)

(73) Assignee: Macpherson Design & Consulting, LLC, Portland, OR (US)

( * ) Notice: Subject to any disclaimer, the term of this patent is extended or adjusted under 35 U.S.C. 154(b) by 346 days.

(21) Appl. No.: 13/439,070

(22) Filed: Apr. 4, 2012

(65) Prior Publication Data

US 2013/0264796 A1 Oct. 10, 2013

(51) Int. Cl.
*A61G 5/12* (2006.01)
*A61G 5/10* (2006.01)

(52) U.S. Cl.
CPC ..... *A61G 5/12* (2013.01); *A61G 2005/1054* (2013.01); *A61G 2005/127* (2013.01); *A61G 2005/128* (2013.01)

(58) Field of Classification Search
CPC ..... A61G 5/12; A61G 2005/1054; A61G 2005/127; A61G 2005/128
USPC ..... 280/304.1, 291; 297/423, 433, 434, 297/435, 429, 436, 375; 74/98, 109
See application file for complete search history.

(56) References Cited

U.S. PATENT DOCUMENTS

| | | | | |
|---|---|---|---|---|
| 4,039,223 | A | 8/1977 | Kristensson | |
| 5,033,793 | A * | 7/1991 | Quintile | 297/423.33 |
| 5,328,247 | A * | 7/1994 | Lovins | 297/423.3 |
| 5,609,066 | A * | 3/1997 | Bunker et al. | 74/537 |
| 5,711,580 | A | 1/1998 | Barclay et al. | |
| 6,217,050 | B1 * | 4/2001 | Dickie et al. | 280/291 |
| 6,623,022 | B2 * | 9/2003 | Malassigne et al. | 280/250.1 |
| 8,166,988 | B1 * | 5/2012 | Martin | 135/67 |
| 2003/0075967 | A1 | 4/2003 | Ciolfe et al. | |
| 2006/0012148 | A1 * | 1/2006 | Melgarejo et al. | 280/304.1 |

OTHER PUBLICATIONS

VanOS Excel G4 Product Manual, p. 15, Fig. 11.

* cited by examiner

*Primary Examiner* — Joseph Rocca
*Assistant Examiner* — Jacob Knutson
(74) *Attorney, Agent, or Firm* — Mersenne Law

(57) ABSTRACT

A wheelchair leg-rest adapter is configured to attach to a wheelchair using mounting features functionally compatible with those of a leg rest suitable for the wheelchair, and having mounting features functionally compatible with those of a wheelchair suitable for the leg rest. The leg-rest mounting features are pivotally connected to the structure comprising the wheelchair mounting features, so that a leg rest attached to the former can rotate relative to a wheelchair attached to the latter. The adapter further comprises an adjustment mechanism to move an effective pivot point between the leg-rest and wheelchair mounting features at least in a vertical direction, to bring the pivot point near the knee of a user of the wheelchair.

14 Claims, 6 Drawing Sheets

220
230
210
520
420
450
430
460
570
470
270
410
500

ADJUSTABLE WHEELCHAIR ELEVATING LEG REST

FIELD

The invention relates to knee, leg or foot rests for chairs and seats. More specifically, the invention relates to adjustable, pivotally moveable footrests that are connected to the chair or seat for relative movement.

BACKGROUND

Many people suffer from disabilities that affect their life activities. Fortunately, some disabilities can be ameliorated or even alleviated through the use of engineered devices. For example, a cane or walker can help someone with strength or balance problems, while a pacemaker can improve a cardiac patient's quality of life.

One common assistive device that is beneficial to both temporarily- and permanently-disabled individuals is the wheelchair. These are available in a wide range of styles, from light-duty, temporary chairs, to racing and cross-country chairs and fully-powered electric models. Although wheelchairs can be useful in a variety of situations, lower-body and leg injuries are disproportionately common among the difficulties faced by a wheelchair user.

For this reason, many chairs include leg-support structures (generically, "leg rests") to improve user comfort and convenience. Of course, users' bodies are different sizes and proportions, so it is important for the leg rests (as well as other parts of the chair) to be adjustable, and to be carefully adjusted to fit the user. With respect to leg rests in particular, a problem often encountered is that the rests must be moved, raised and lowered (e.g., to provide suitable ground clearance), and rotated (or swung) up and down (extending the leg) to improve comfort or promote circulation.

A number of mechanisms for adjustable and extensible leg rests are known in the art, but a common problem is that the effective rotation center of many rests is offset from the leg-rotation (extension) center at the user's knee, which causes either the flexed or extended leg-rest length to be wrong. (In other words, a leg rest properly adjusted for length in the flexed position, is too short in the extended position; or vice versa.) Mechanisms designed to address this problem are often complex, heavy or prone to breakage. Furthermore, such existing mechanisms are incompatible with standardized, mass-produced, inexpensive leg-rest components that fit many existing wheelchairs. (FIG. 2 shows an example "universal" leg rest 210, including the standardized attachment points 220 and 230, which mate with corresponding points 240 and 250 of compatible wheelchairs This Figure also shows the length adjustment feature of the leg rest 260 and a fold-down foot rest 270.)

A new wheelchair accessory that can convert a standard wheelchair and universal leg rest into a length-corrected, extendable leg rest may be of significant value to many wheelchair users.

SUMMARY

Embodiments of the invention add at least one degree of freedom to the adjustment of a wheelchair leg rest so that the rest can be extended and retracted without requiring a compensating adjustment in length. Many embodiments are designed to work with existing non-extendible leg rests.

BRIEF DESCRIPTION OF DRAWINGS

Embodiments of the invention are illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

DETAILED DESCRIPTION

Embodiments of the invention provide for adjustment of the location of a pivot point where an elevating leg rest attaches to a wheelchair. Adjusting the pivot point to be closer to the user's knee allows the foot support of the leg rest to travel in a similar arc as the user's lower leg and foot, so the foot support remains at a comfortable position, neither too near nor too far from the front of the chair.

Figure 1:
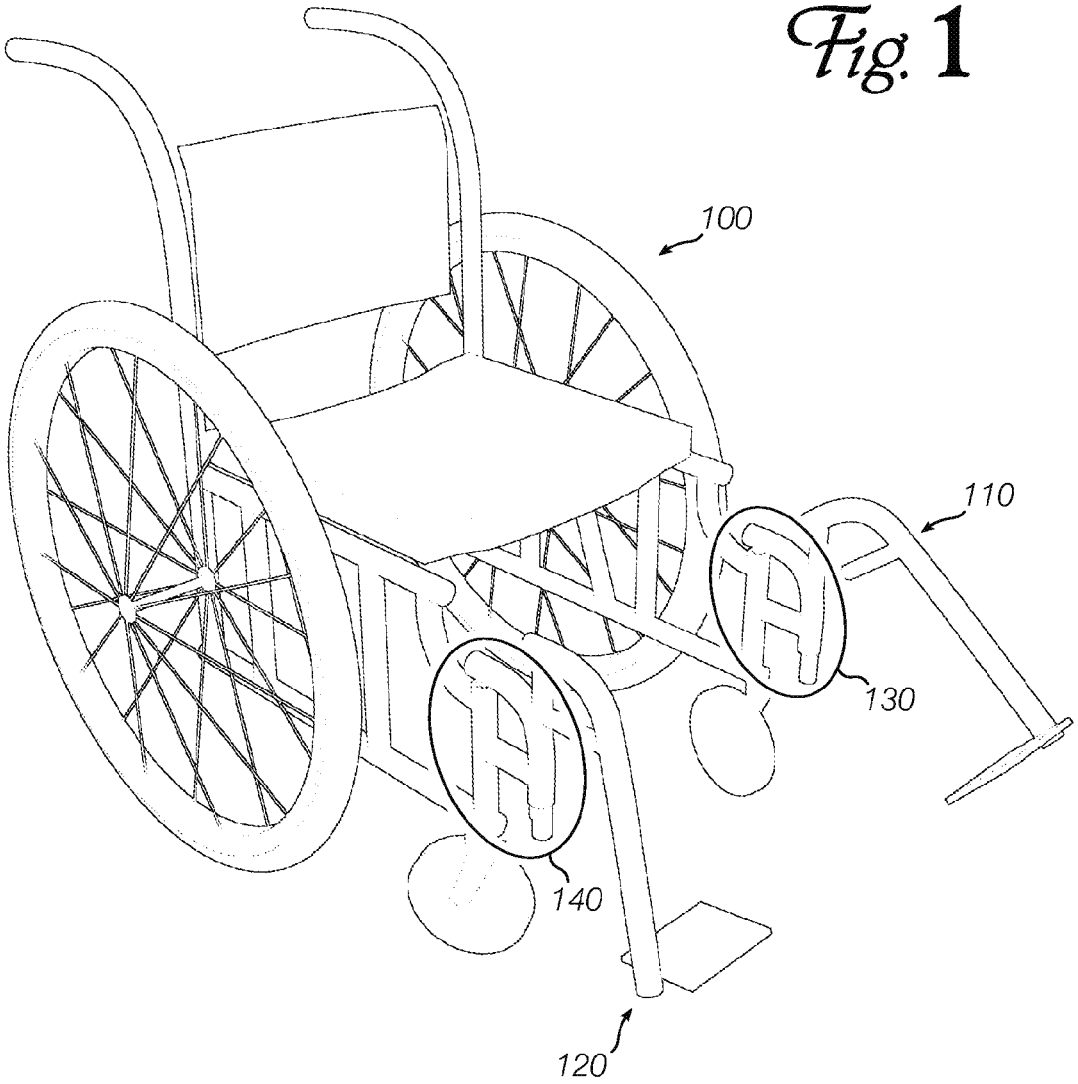
FIG. 1 shows a general-perspective view of a wheelchair fitted with an embodiment of the invention.

FIG. 1 shows a general-perspective view of a wheelchair 100 fitted with left and right leg rests 110 and 120, attached to the chair by embodiments of the invention at 130 and 140. The right leg rest is shown in the lowered position (the user's leg would be flexed at about 90°) while the left leg rest is shown in the raised (elevated or extended) position, where the user's lower leg would extend out in front, perhaps supported by a calf pad (not shown).

Figure 3B:
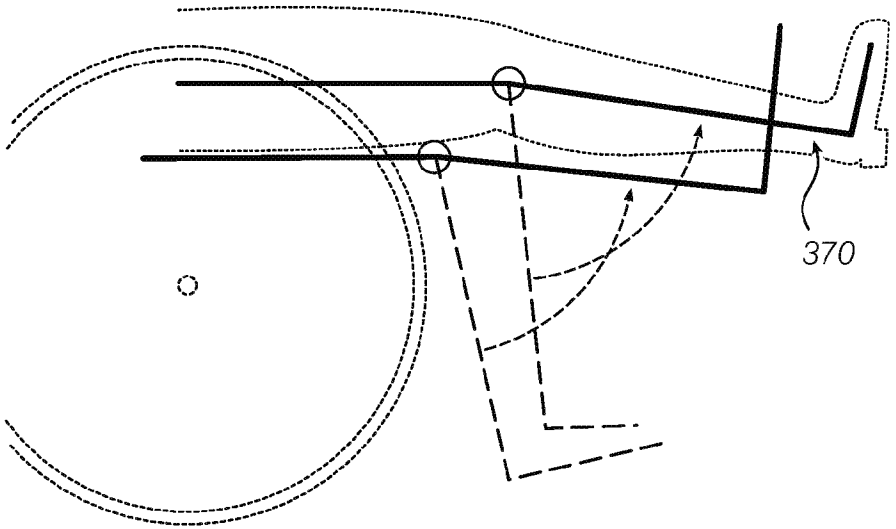
FIGS. 3A and 3B are diagrams illustrating the problem to be addressed by embodiments of the invention.
Figure 3A:
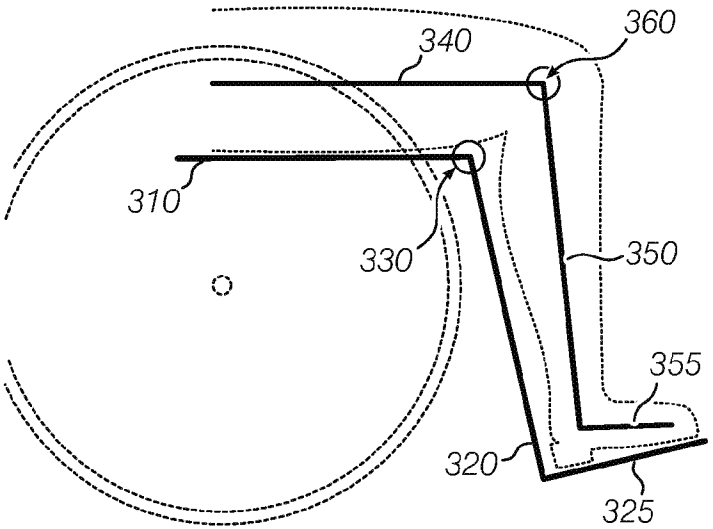

FIG. 3A shows a representative side view of a wheelchair, with key portions of the chair and user identified by reference characters. The heavy horizontal line at 310 indicates the seat of the wheelchair, while line 320 (and short perpendicular line 325) represent the leg rest and foot support. The leg rest is rotatably attached to the seat at the seat's front edge, 330.

The user's thigh is represented by heavy horizontal line 340, while his lower leg and foot are shown as 350 and 355. These lines may be thought of as approximating the location and orientation of the bones of the leg and foot: the femur, tibia/fibula, tarsus, metatarsus and phalanges. Rotation of the lower leg relative to the upper leg occurs at the knee 360.

As shown in FIG. 3B, elevating the leg rest and lower leg results in a mismatch 370 between the elevated leg-rest length and the length of the user's leg. This mismatch occurs because the leg rest and lower leg follow different arcs about their respective pivot points as they are raised. Embodiments of the invention permit the adjustment of the leg rest pivot point to bring it nearer the user's knee. When so adjusted, the leg rest and lower leg follow similar arcs, and the extended leg-rest length need not be altered to maintain user comfort.

FIGS. 4A-4D show top, front, left and perspective views of an embodiment of the invention with a prior-art universal, length-adjustable leg rest in place. Details are most easily indicated in side view 4C, so that is where most reference characters are placed. However, each of these views was created from a single three-dimensional model, so each shows substantially the same elements, except where one element occludes visibility of another one in a particular view.

Figure 2:
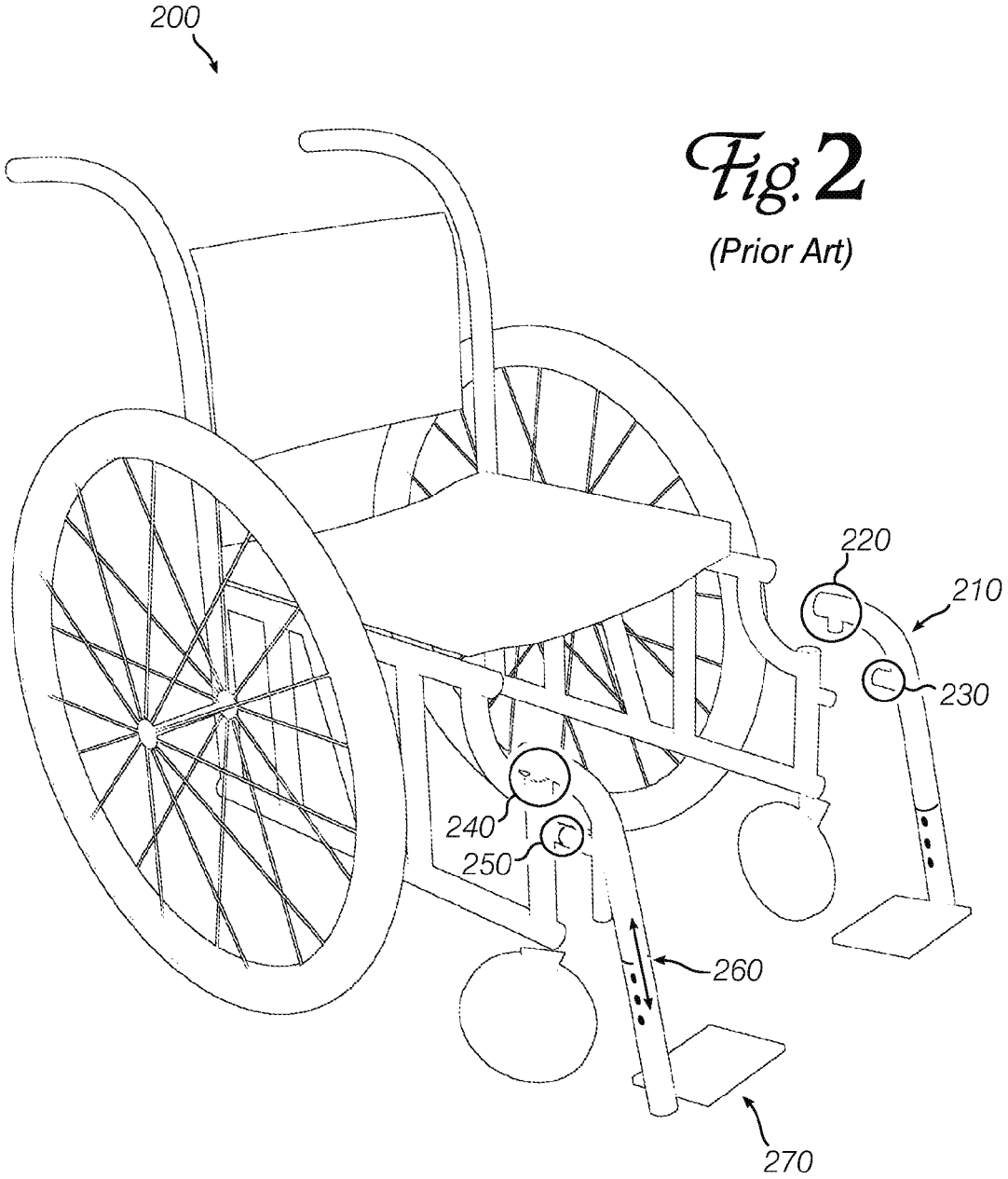
Fig. 2 (Prior Art)
FIG. 2 shows a prior-art leg rest attached to a wheelchair in the conventional way.
Figure 4C:
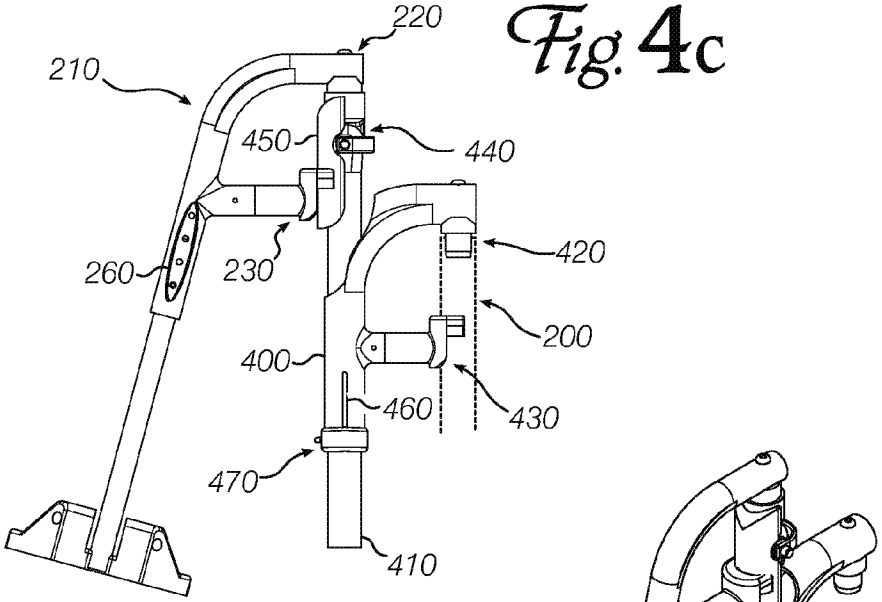
FIGS. 4A-4D show several views of an embodiment of the invention with a prior-art length-adjustable "universal" leg rest attached.
Figure 4D:
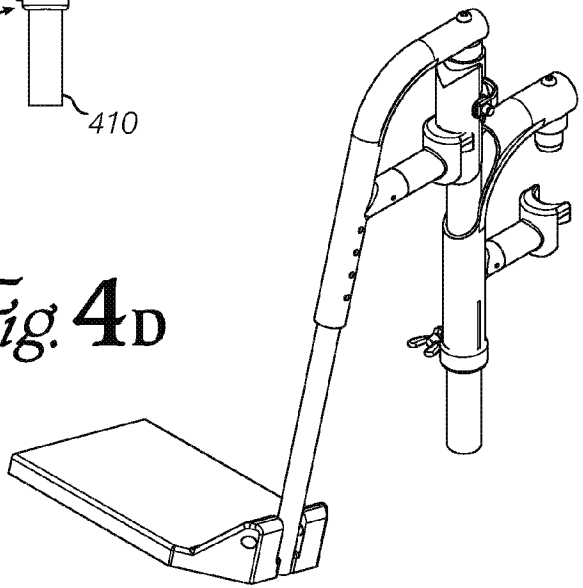
Figure 4A:
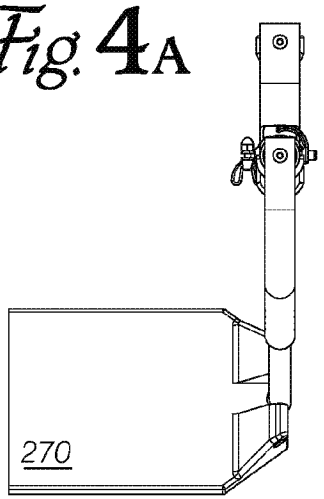
Figure 4B:
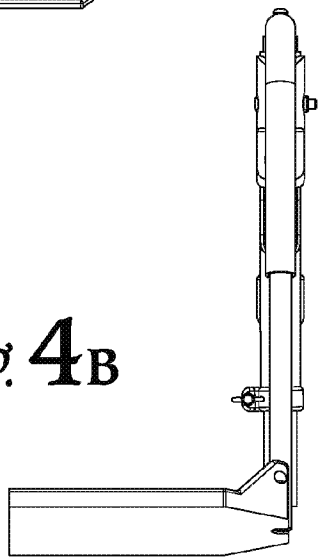

At the left side of FIG. 4C, the standard universal leg rest is identified generally as 210. In this view, the length-adjusting holes 260 are apparent, as are mounting bosses 220 and 230, by which the leg rest may be attached to a compatible wheelchair (see, for example, FIG. 2.) The embodiment of the invention comprises a main body tube 400, curved into roughly horizontal and roughly vertical portions, through which a slidably-adjustable vertical tube 410 passes. At the upper end of the adjustable tube is a pivot mechanism 440, including a shield 450 against which mounting boss 230 rests (or, in some embodiments, to which it is secured).

At the right side of the figure, the embodiment's mounting bosses 420 and 430 are visible. These bosses connect the embodiment to the wheelchair (for example, the upper boss 420 fits into, and the lower boss 430 rests against, a vertical tube of the frame of the wheelchair, indicated in this figure by dashed lines 200. Vertical adjustment tube 410 can be secured in place by a locking mechanism 470 (in the embodiment depicted here, the locking mechanism comprises a simple slot 460 in the main body 400 to form a split-flange feature, with a thumb-screw adjustable compression ring 470 to hold tube 410 at a desired position. In use, locking mechanism 470 would be released and tube 410 adjusted vertically to bring pivot 430 near the seated wheelchair user's knee. Then compression ring 470 would be tightened to lock tube 410 and pivot 440 in position.

In some embodiments, other locking mechanisms may be used. For example, a lever and cam "quick release" may substitute for the thumb-screw adjustable compression ring. Alternatively, for more-permanent installations, a set screw or grub screw may secure the sliding tube. If fine adjustability is not necessary, a five- or six-hole captured-pin or shear-pin adjustment, similar to the length adjuster of the leg rest, may be provided. The important capability of the adjuster is that it allow at least vertical movement and positioning of pivot 440, to bring the pivot nearer the wheelchair user's knee.

It is appreciated that, for best results, the pivot point must be both vertically and horizontally near the user's knee when viewed from the side (but need not be near the knee medially). The embodiments shown in FIGS. 1 and 4A - 4D only allow pivot adjustment in the vertical direction. This is acceptable for many wheelchair applications because the position of the user's knee can be moved fore and aft by using existing adjustment features of the wheelchair. Since fore/aft adjustment is available in the chair already, an embodiment of the invention may be constructed more simply, reliably and inexpensively by providing only up-and-down adjustment of the pivot point. However, for use on wheelchairs that lack adequate fore/aft adjustability, an embodiment may allow the pivot point to be adjusted in more than one direction.

Figure 5:
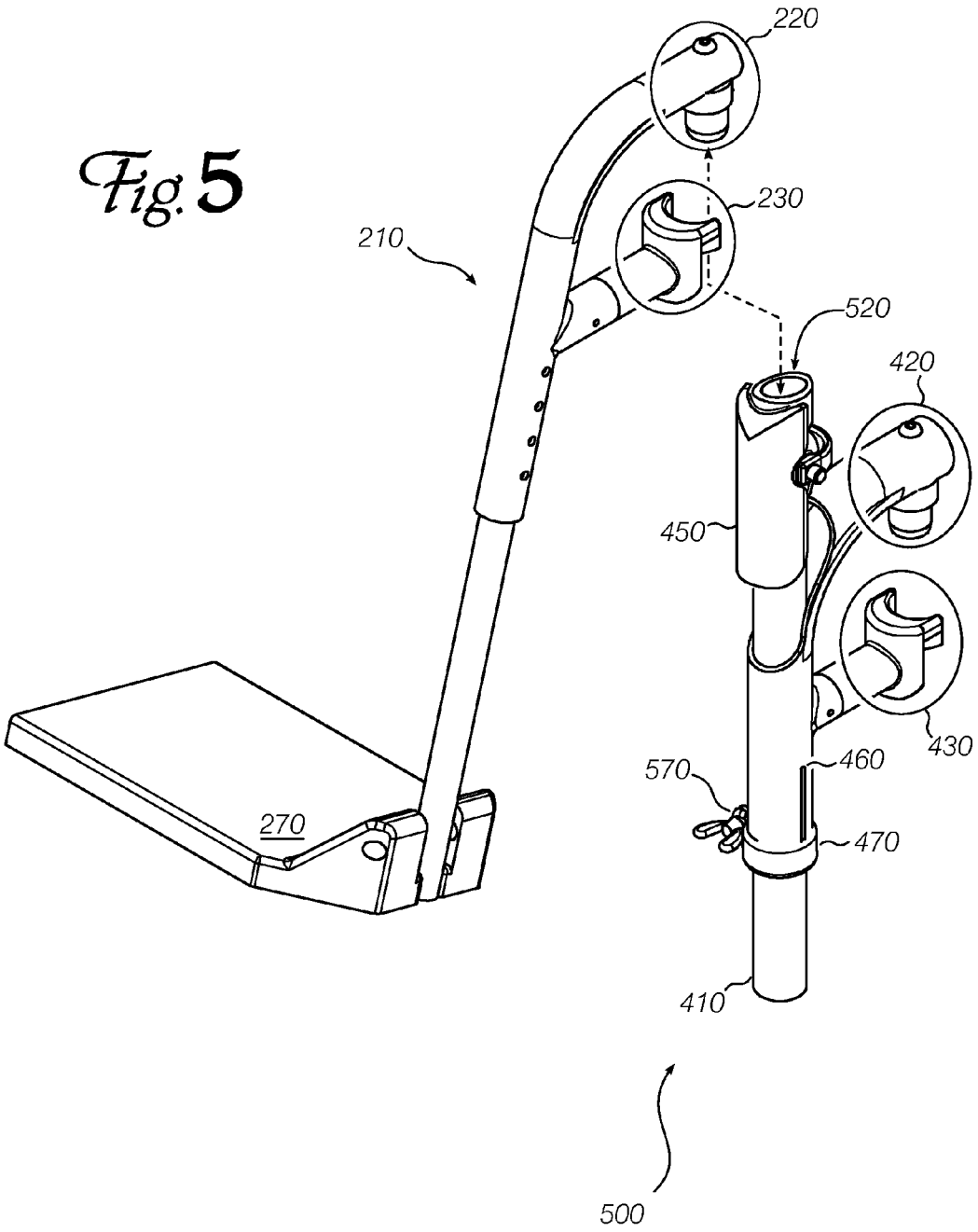
FIG. 5 shows an exploded view of an embodiment of the invention.

FIG. 5 is an exploded view of the embodiment shown in FIG. 4. Since adjustable leg rest 210 has been removed from the embodiment (generally, 500), its complete mounting bosses 220, 230 are visible. Note that they are functionally interchangeable with the corresponding mounting bosses 420 and 430 on the embodiment, because the embodiment connects to the wheelchair in place of the leg rest. In this exploded view, receptacle 520 is visible. Mounting boss 220 (a cylindrical, expandable plug) fits into this receptacle (just as mounting boss 420 fits into a corresponding receptacle in the wheelchair frame), while mounting boss 230 (a substantially horizontal stay) rests against shield 450. Shield 450 mostly obscures the pivot point in this figure, so the pivot is not identified with a reference character. Clamping mechanism 570 is visible.

It is appreciated that the two sets of mounting features of an embodiment (the features that connect to the leg rest assembly, and the features that connect to the wheelchair) may be similar (if the embodiment is to be interposed between a leg rest and a wheelchair for which the leg rest is designed); or different (if the embodiment is to be interposed between a leg rest and a different wheelchair, with which the leg rest could not ordinarily be used). In other words, in addition to allowing adjustment of the elevating leg rest pivot point so that the leg rest length need not be adjusted between the elevated and retracted positions, an embodiment can serve as an adapter to allow one type of leg rest to be used with a different type of wheelchair. As an alternative way of describing this property of an embodiment, note that the two sets of mounting features are complementary. In an embodiment designed for use with a leg rest and the wheelchair for which the leg rest is designed, two instances of the embodiment can be connected together because the leg-rest mounting features of one instance will mate properly with the wheelchair mounting features of the other instance. By contrast, in a "heterogeneous" embodiment (designed to fit between a wheelchair and a leg rest designed for a different, incompatible wheelchair), two instances of the heterogeneous embodiment cannot be connected together because the mounting features are not compatible.

Figure 6C:
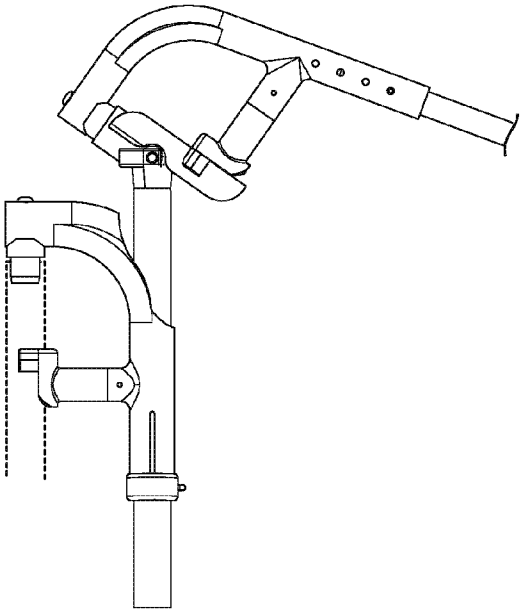
FIGS. 6A-6C show side views of an embodiment of the invention in flexed, intermediate and extended positions
Figure 6B:
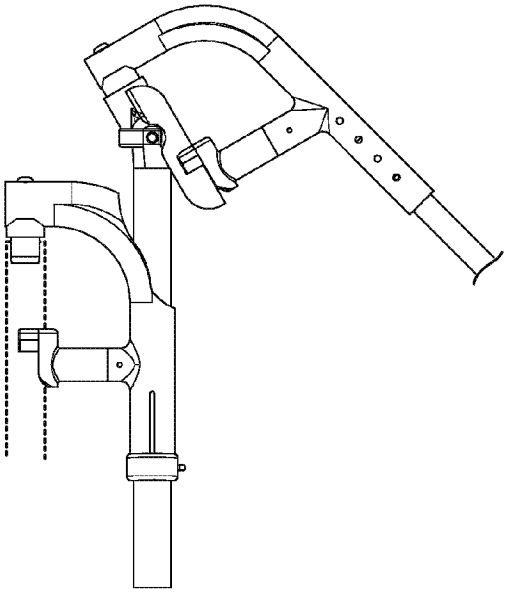
Figure 6A:
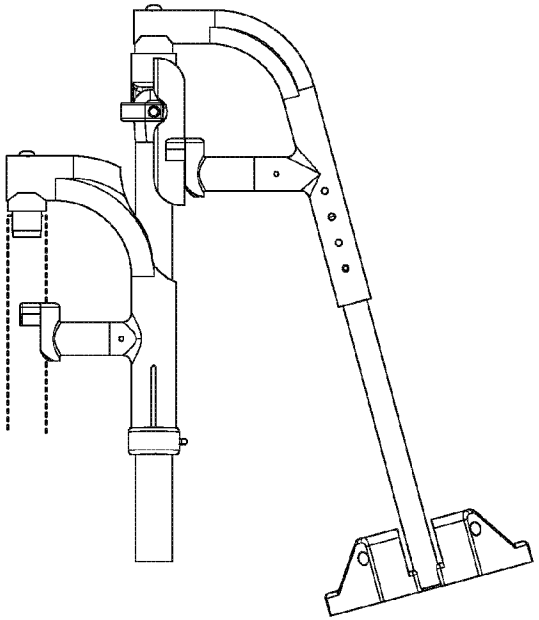

FIGS. 6A-6C show side views of an embodiment of the invention as the leg rest rotates from fully-flexed to fully-extended position. Note that rotation occurs generally about the pivot point 430 (which has been adjusted to be near the wheelchair user's knee).

The embodiments illustrated in FIGS. 4-6 only permit adjustment of the leg-rest pivot point in a roughly vertical direction. The main body of an embodiment, e.g. support sleeve 400, advances the vertical support 410 forward from the frame tube 200, but the amount of advance is not adjustable. However, differently-dimensioned support sleeves can be provided so that the vertical support 410 is placed closer or further away from the front edge of the seat. Note that the portions of the embodiment that engage the wheelchair frame (e.g., upper plug 420 and midpoint strut 430) are designed to emulate (in size and orientation) the corresponding features of the leg rest 210, while the portions of the embodiment that engage the leg rest (e.g., socket 520 and shield 450) similarly emulate corresponding features of the wheelchair frame. Thus, these embodiments can be used to convert a wheelchair with a fixed leg rest (or an elevating leg rest with an incorrectly-positioned pivot point) into a wheelchair with an adjustable, elevating leg rest. The use of standard mounting features and orientations also allows the use of existing replacement parts.

Embodiments of the present invention have been described largely by reference to specific examples and in terms of particular physical structures to achieve the useful characteristics described. However, those of skill in the art will recognize that adjustable elevating leg rests for wheelchairs can also be constructed using different components and arrangements. Such variations and implementations are understood to be captured according to the following claims.

I claim:

1. An improved wheelchair leg rest mounting mechanism to be interposed between a wheelchair and a leg rest for coupling the leg rest to the wheelchair, the leg rest mounting mechanism comprising:

a first plurality of mounting features, said first plurality being functionally interchangeable with a corresponding plurality of mounting features of the leg rest and thus suitable for coupling to the wheelchair;

a second plurality of mounting features, said second plurality being functionally interchangeable with a corresponding plurality of mounting features of the wheelchair and thus suitable for coupling to the leg rest;

a pivot mechanism to permit the second plurality of mounting features to rotate with respect to the first plurality of mounting features; and an adjustment mechanism to permit movement of the pivot mechanism so that an effective pivot point of the pivot mechanism can be moved to a position laterally near a knee of a user of the wheelchair.

2. The improved wheelchair leg rest mounting mechanism of claim 1 wherein the first plurality of mounting features comprises a cylindrical plug.

3. The improved wheelchair leg rest mounting mechanism of claim 1 wherein the first plurality of mounting features comprises a substantially horizontal stand-off.

4. The improved wheelchair leg rest mounting mechanism of claim 1 wherein the second plurality of mounting features comprises a receptacle to accept a cylindrical plug of the leg rest.

5. The improved wheelchair leg rest mounting mechanism of claim 1 wherein the second plurality of mounting features comprises a semi-cylindrical shield against which a substantially horizontal stand-off of the leg rest is to rest.

6. The improved wheelchair leg rest mounting mechanism of claim 1 wherein the adjustment mechanism comprises a tube slidably coupled to a support structure, the support structure comprising means for locking the tube in place and preventing the sliding motion.

7. The improved wheelchair leg rest mounting mechanism of claim 6 wherein the means for locking is a compression ring actuated by a thumb screw.

8. The improved wheelchair leg rest mounting mechanism of claim 6 wherein the means for locking is a compression ring actuated by a quick-release lever and cam.

9. The improved wheelchair leg rest mounting mechanism of claim 6 wherein the means for locking is a shear pin.

10. The improved wheelchair leg rest mounting mechanism of claim 6 wherein the means for locking is a set screw.

11. The improved wheelchair leg rest mounting mechanism of claim 1 wherein:

the first plurality of mounting features consists of a cylindrical plug and a substantially horizontal stand-off;

the second plurality of mounting features consists of a receptacle to accept a cylindrical plug of the leg rest and a semi-cylindrical shield against which a substantially horizontal stand-off of the leg rest is to rest;

the adjustment mechanism consists of a tube slidably coupled to a support structure, the support structure comprising means for locking the tube in place and preventing the sliding motion.

12. The improved wheelchair leg rest mounting mechanism of claim 1, further comprising:

a plurality of support sleeves, each support sleeve constructed with the first plurality of mounting features and each support sleeve having different horizontal dimensions from another support sleeve of the plurality of support sleeves, said different horizontal dimensions allowing the adjustment mechanism to be place closer to or further from a front edge of a seat of the wheelchair.

13. The improved wheelchair leg rest mounting mechanism of claim 1, further comprising:

a main body tube carrying the first plurality of mounting features;

a slidably-adjustable vertical tube carrying the pivot mechanism; and a locking mechanism, wherein the main body tube is curved into roughly horizontal and roughly vertical portions, the locking mechanism disposed upon the roughly vertical portion of the main body tube, and the slidably-adiustable vertical tube passing through the locking mechanism.

14. The improved wheelchair leg rest mounting mechanism of claim 1, further comprising:

a wheelchair having leg-rest mounting features to attach the leg rest to the wheelchair; and the leg rest is a fixed, non-elevating leg rest having wheelchair mounting features to attach the fixed, non-elevating leg rest to the wheelchair, wherein the first plurality of mounting features are functionally interchangeable with the wheelchair mounting features of the fixed, non-elevating leg rest; and the second plurality of mounting features are functionally interchangeable with the leg-rest mounting features of the wheelchair, so that when the first plurality of mounting features are attached to the wheelchair and the second plurality of mounting features are attached to the fixed, non-elevating leg rest, the pivot mechanism permits the fixed, non-elevating leg rest to rotate with respect to the wheelchair.

* * * * *